US006058732A

United States Patent [19]

Kato et al.

[11] Patent Number: 6,058,732

[45] Date of Patent: May 9, 2000

[54] ICE MAKING MACHINE

[75] Inventors: Sonoo Kato; Hatsuo Yamada; Tadashi Sakai, all of Aichi-ken, Japan; Douglas Troy Steward, Newnan, Ga.

[73] Assignee: Hoshizaki Denki Kabushiki Kaisha, Toyoake, Japan

[21] Appl. No.: 09/189,987

[22] Filed: Nov. 12, 1998

[30] Foreign Application Priority Data

Nov. 20, 1997 [JP] Japan ..... 9-319712

[51] Int. Cl.[7] ..... F25C 1/12

[52] U.S. Cl. ..... 62/347

[58] Field of Search ..... 62/347, 348, 344

[56] References Cited

U.S. PATENT DOCUMENTS 3,812,686 5/1974 Tester ..... 62/348
4,722,199 2/1988 Hibino ..... 62/344
5,131,234 7/1992 Furujkawa et al. ..... 62/344
5,345,782 9/1994 Takahashi et al. ..... 62/347

*Primary Examiner*—William E. Tapolcai
*Attorney, Agent, or Firm*—Wenderoth, Lind & Ponack, L.L.P.

[57] ABSTRACT

An ice making machine is provided comprising an ice making chamber and an ice reservoir defined by an insulating material. Ice making plates are vertically disposed beneath a water sprinkler for receiving ice-making water supplied therefrom. The ice-making machine further comprises an ice-making water tank for storing the ice-making water, and an assembly of a pump and a motor for supplying the ice-making water stored in the ice-making water tank to the water sprinkler. An insulating rear panel of a predetermined shape is arranged along the ice making plates between a machine chamber and the ice making chamber. The rear panel is formed by bending one insulating panel into the predetermined shape at a given portion thereof for the arrangement between the machine chamber and the ice making chamber.

9 Claims, 3 Drawing Sheets

ICE MAKING MACHINE

BACKGROUND OF THE INVENTION

1. Field of the Invention

The present invention relates to an ice making machine used to produce cube ice or crushed ice such as crescent ice (hereinafter referred to as "cube ice").

2. Description of the Related Art

Cube ice, such as crescent ice, is generally produced by a vertical ice making machine referred to as a cyclic flow-down ice making machine. This type of ice making machine comprises a main body having therein an ice making chamber or an ice reservoir defined by an insulating material, a water sprinkler located within the ice making chamber of the main body, a vertical ice making plate or plates onto which ice-making water is supplied from the water sprinkler, an evaporator arranged on the ice making plate in heat exchange relationship therewith, and an ice-making water tank disposed below the ice making plate. The ice-making water contained in the ice-making water tank is delivered to the water sprinkler, from which the water is sprayed onto the ice making plate. The ice-making water is then cooled to freeze while flowing down on the surface of the ice making plate. In this arrangement, the ice-making water that is not frozen is returned to the ice-making water tank. Accordingly, the ice-making water is repeatedly supplied from the ice-making water tank to the ice making plate by a pump, so that ice having a predetermined thickness or dimensions may be formed on the surface of the ice making plate. In other words, such an operation is repeated until the water in the ice-making water tank is reduced to a predetermined amount.

However,in the above ice making machine, there is a problem in that when a motor for driving the pump is disposed in the ice making chamber, the temperature in the ice making chamber may increase due to the heat generated by the motor. Therefore, solid ice of good quality cannot be formed on the surface of the ice making plate, or a long time period may be required to complete one ice making operation cycle. For this reason, an insulating rear panel is installed) between an upper machine chamber (in which the motor is installed and the rear side of the ice making plate to prevent the temperature increase within the ice making chamber.

Nevertheless, in the conventional method, two flat insulating panels formed into an L shape by being bonded to each other are used as a rear panel to be installed behind the ice making plate. Still, because of insufficient application of adhesive, degradation of the adhesive itself, or a deficiency in the bonding process, a gap may form between the bonded portions of the two insulating panels, and warmer air contained in the upper machine chamber may flow into the ice making chamber through the gap causing the temperature in the ice making chamber to rise. This, predictably, adversely affects the quality of ice being formed on the surface of the ice making plate. Furthermore, completely bonding the two flat insulating panels to each other requires surprising skill and costs.

SUMMARY OF THE INVENTION

The present invention has been made in view of the foregoing problems, and an object of the present invention is to provide an ice making machine capable of producing ice of good quality on the surface of an ice making plate or plates in which such problems are avoided so that air in an upper machine chamber does not flow into an ice making chamber to thereby raise the temperature in the ice making chamber.

In order to attain the above-described object, the ice making machine in accordance with the present invention comprises: a main body having therein an ice making chamber and an ice reservoir defined by an insulating material; a water sprinkler disposed within the ice making chamber; an ice making component (generally, a plate) vertically disposed beneath the water sprinkler for receiving ice-making water supplied from the water sprinkler and for changing the ice-making water into ice; an evaporator placed in contact with the ice making plate in a heat exchange relationship for cooling the ice making plate; an ice-making water tank for storing any unfrozen ice-making water, flowing down the surface of the ice making plate; an ice guide member diagonally arranged between the ice making plate and the ice-making water tank for guiding the ice into the ice reservoir and for allowing the ice-making water to pass through the slanted ice guide member into the ice-making water tank; a machine chamber arranged outside the ice making chamber and defined around the ice making plate; and a pump and motor assembly for supplying the ice-making water stored in the ice-making water tank to the water sprinkler. The pump is located within the ice-making water tank, and the motor is located within the machine chamber. An insulating rear panel having a predetermined shape is disposed along the ice making plate and between the machine chamber and the ice making chamber. The rear panel is formed into the predetermined shape by bending one insulating panel at a given portion thereof for the arrangement between the machine chamber and the ice making chamber.

In such an arrangement of the ice making machine according to the present invention, an elongated groove is preferably formed at the given portion in the insulating panel. The elongated groove extends in the width direction of the ice making plate when the rear panel is arranged between the machine chamber and the ice making chamber. Further, it is appropriate that the elongated groove have a substantially V-, U-, or C-shape.

Still further, according to the present invention, the ice making component preferably comprises a pair of ice making plates vertically disposed beneath the water sprinkler with the evaporator sandwiched therebetween.

The ice guide member is diagonally arranged downward of the ice making plates and upward of the ice-making water tank in order to guide the ice received from the ice making plates into the ice reservoir. The machine chamber vertically extends upward of the ice-making water tank in juxtaposition with the ice making plates. The rear panel has the predetermined substantially L-shape, the leg of the L-shape vertically extending along the ice making plates, and the bottom thereof being arranged between the machine chamber and the ice-making water tank. The insulating panel that makes up the rear panel thus arranged is formed with a groove extending in the widthwise direction of the ice making plates at a position corresponding to the upper end of the ice guide member, and the upper end of the ice guide member is being received into and supported by the groove.

BRIEF DESCRIPTION OF THE DRAWINGS

For a better understanding of the present invention, reference is made to the detailed description to be read in conjunction with the accompanying drawings, in which.

DETAILED DESCRIPTION OF THE INVENTION

Figure 1:
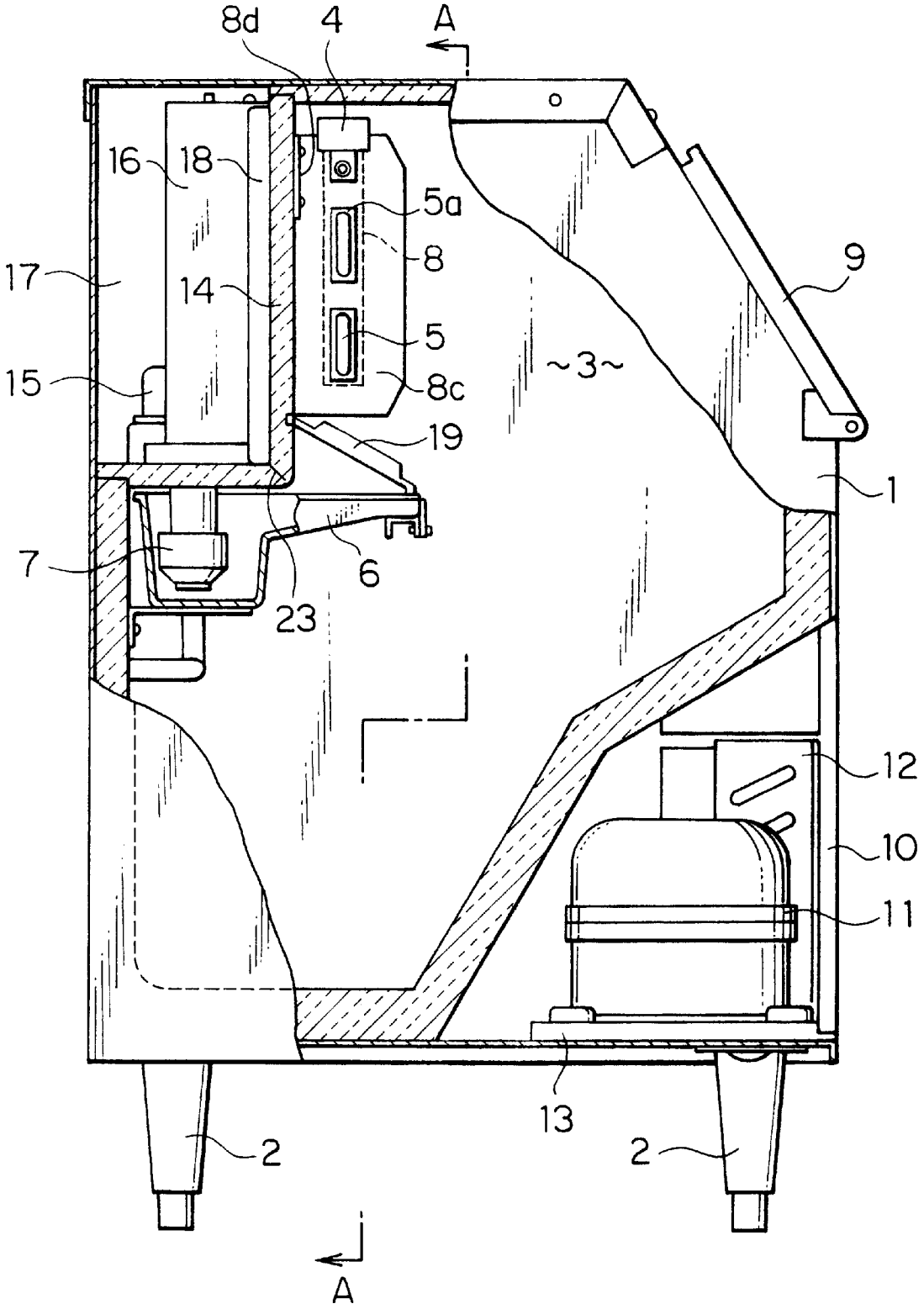
FIG. 1 is a partially cutout side elevational view showing an ice making machine in accordance with a preferred embodiment of the present invention.

Now, a detailed description will be made of some of the embodiments of the present invention with reference to the accompanying drawings, in which identical reference numerals denote the same or corresponding portions. As is apparent from the following description, the present invention is not to be limited to these embodiments and various modifications can be made without departing from the spirit of the invention.

Figure 2:
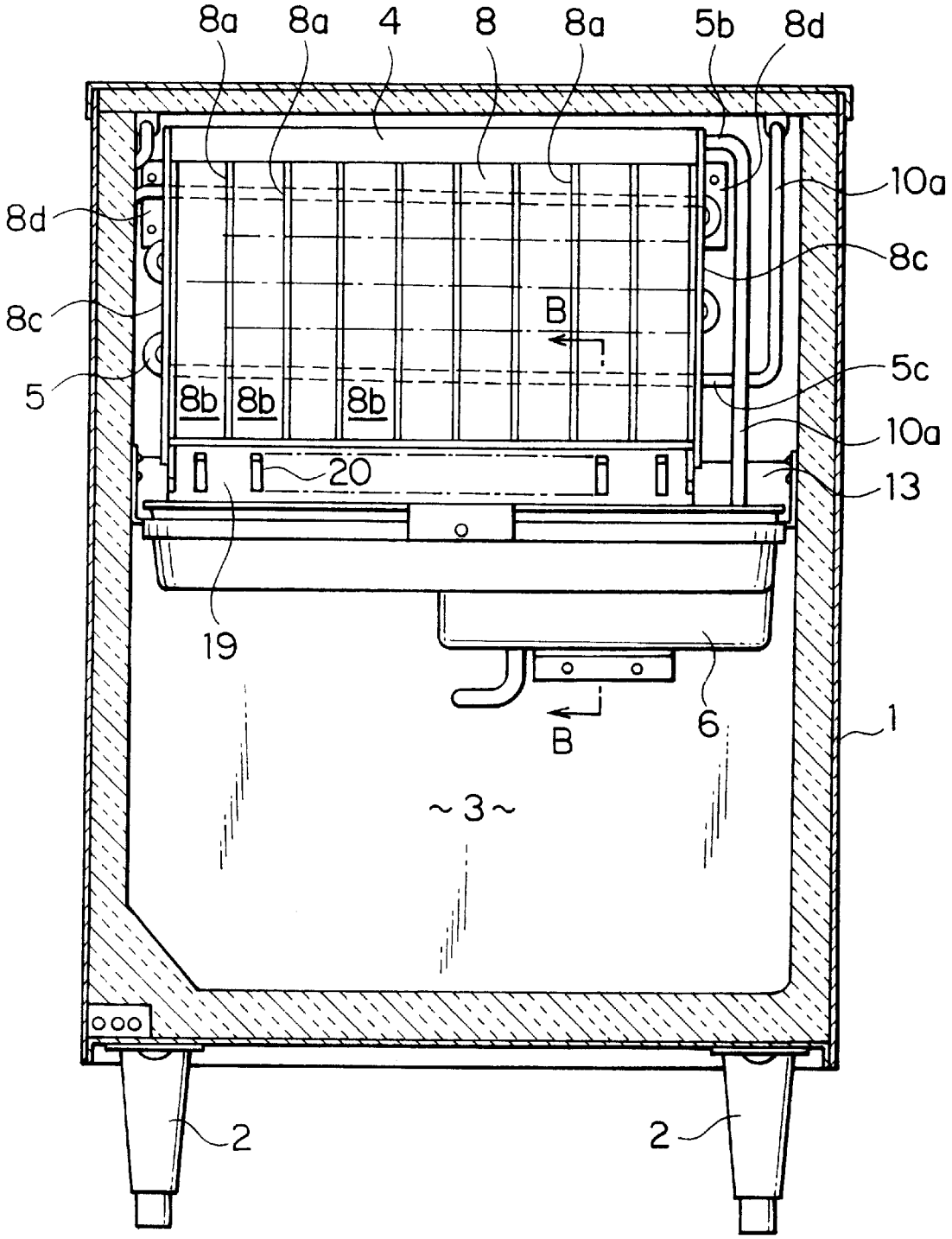
FIG. 2 is a cross-sectional view taken along the line A—A of FIG. 1.

FIG. 1 is a partially cutout side elevational view showing an ice making machine in accordance with an embodiment of the present invention, and FIG. 2 is a sectional view taken along the line A—A of FIG. 1. As best shown in FIG. 1, the ice making machine of the present invention comprises a main body 1 formed into a box-like shape, and a plurality of supporting legs 2 for supporting the main body 1 at the bottom thereof An ice making chamber 3 having an ice reservoir formed integrally therewith is defined in the interior of the main body 1. The ice making chamber 3 is provided with an insulating material that substantially surrounds the chamber and forms the main body 1. An ice making mechanism including a water sprinkler 4, an evaporator 5, and ice making plates 8, described later, is provided at an upper portion of the ice making chamber 3.

In this embodiment, the evaporator 5 is disposed below the water sprinkler 4 and is sandwiched between a pair of ice making plates 8. The ice-making water sprayed from the water sprinkler 4 flows down an ice-making surface of each ice making plate 8 (i.e., a surface opposite the surface facing the evaporator 5), and any unfrozen water is stored in a water tank 6 disposed beneath the ice making plates 8. The ice-making water tank 6 is shaped substantially like the beak of a pelican. The ice-making water reserved in the ice-making water tank 6 is repeatedly supplied to the water sprinkler 4 by a pump 7 so that ice having a predetermined thickness or dimensions may be formed on the surface of each ice making plate 8. In other words, such an operation is continued until the ice-making water in the ice-making water tank 6 is reduced to a predetermined level.

The main body 1 is provided with an ice retrieval opening at the upper front portion of the ice making chamber 3, and the ice retrieval opening can be freely opened and/or closed by a cover panel 9 pivotably supported on the main body 1. The ice making machine further comprises a lower machine chamber 10 at a lower portion outside the main body and in front of the ice making chamber 3 (as viewed from the right in FIG. 1). The lower machine chamber 10 may be open at the front side of the main body 1. The lower machine chamber 10 contains therein a conventional freezer unit comprising a compressor 11, and a condenser 12 for delivering a coolant/refrigerant to the evaporator 5. The freezer unit is seated on a unit base 13, and can be pulled out integrally with the unit base 13 from the lower machine chamber 10.

An upper machine chamber 17 is provided along the ice making plates 8 at the upper rear portion of the main body 1, and accommodates a motor 15 for driving the pump 7 and a control box 16. The upper machine chamber 17 is separated from the ice making chamber 3 by a rear panel 14 made of an insulating material which is arranged behind the ice making plates 8. The rear panel 14 in accordance with the present invention is formed by bending one insulating panel into a substantially L-shape. Control box fixing members 18 are connected together to form an L-shape, and are arranged on the back surface of the rear panel 14 (the rear of the ice making chamber 3). The control box 16 is fixedly arranged in the interior of the upper machine chamber 17 by the control box fixing members 18. The fixing members 18 fix the rear panel 14 into the L-shape. That is, in this arrangement, the leg and the bottom of the L-shaped control box fixing members 18 face the leg and the bottom of the L-shaped rear panel 14, respectively. Since the rear panel 14 is located on the inner side of the control box fixing members 18 (at the side of the ice making plates), the control box fixing members 18 may instead be a single plate in the form of an L-shape, without the necessity of connecting two members.

The main body 1 further comprises an ice guide plate 19 having slits diagonally arranged between the lower ends of the ice making plates 8 and the ice-making water tank 6. Ice detached from the surfaces of the ice making plates 8 is dropped onto the upper surface of the ice guide plate 19 to smoothly run thereon, and then drop from the front end of the ice guide plate 19 to the bottom of the ice making chamber 3. As shown in FIG. 2, a plurality of slits 20 are formed in the ice guide plate 19. Ice-making water flowing down on the surfaces of the ice making plates 8 passes through the slits 20 to enter the ice-making water tank 6 and be stored therein.

Figure 3:
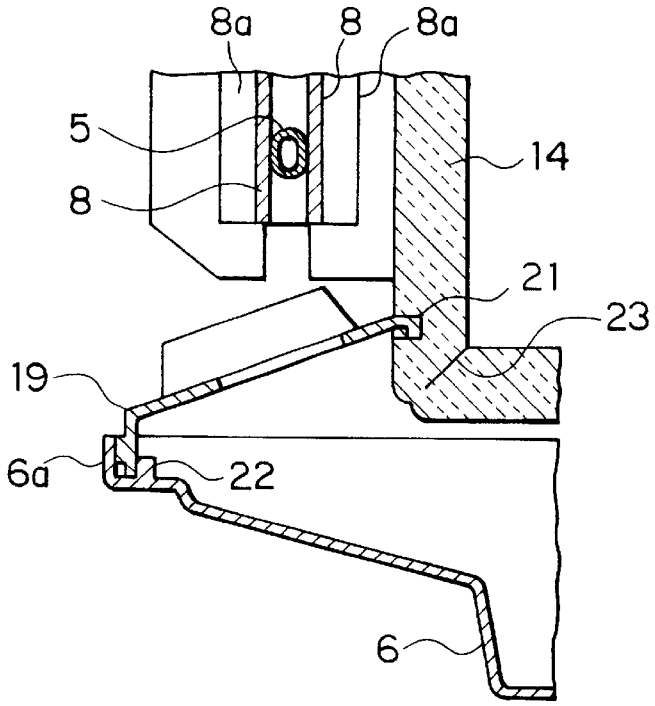
FIG. 3 is a cross-sectional view taken along the line B—B of FIG. 2.

With reference to FIGS. 1 to 3, an ice making mechanism will now be described in detail which comprises the water sprinkler 4, the evaporator 5, and the ice making plates 8. The ice making plates 8 each have a conventional rectangular shape and are vertically disposed so as to sandwich the evaporator 5 therebetween. The evaporator 5 comprises a twisting evaporator pipe 5*a* connected at opposite ends thereof to a refrigerant inlet 5*b* and a refrigerant outlet 5*c*, respectievly, of a refrigerant tube 10*a* extending from the freezer unit located within the lower machine chamber 10 shown in FIG. 1. Each ice making plate 8 is formed with a plurality of elongated protrusions 8*a* extending in a longitudinal direction on the ice-making surface thereof, and is also formed with a plurality of channel-like recesses 8*b* between the protrusions 8*b* adjacent thereto. Ice-making water from the water sprinkler 4 is designed to flow down on the ice-making surface in the recesses 8*b*. The evaporator pipe 5*a* extends so as to twist across the back surface of the recesses 8*b*. With such an arrangement, at the end of the ice making operation cycle, crescent-like ice or cube ice having a predetermined dimension can be produced at portions on the ice-making surface corresponding to the crossing portions.

As best shown in FIG. 2, the ice making machine according to this embodiment includes a supporting bracket 13 extending horizontally across the ice making chamber 3, and each ice making plate 8 is firmly supported by the supporting bracket 13 via side plates 8*c* that are mounted to the side of each ice making plate 8. The side plates 8*c* extend to the edge of the water sprinkler 4 beyond the upper end of the ice making plate 8, and support the water sprinkler 4 at the edge thereof. Each of the side plates 8*c* is also provided with a bracket 8*d* to which the rear panel 14 is mounted.

FIG. 3 is an enlarged partial cross-sectional view taken along the line B—B of the FIG. 2. As shown in this figure, a retaining groove 21 is formed at the lower front portion of the rear panel 14 along the width direction of the ice making plate 8. The rear end of the ice guide plate 19 is engaged with the retaining groove 21. The front end of the ice guide plate 19 is inserted between a front side wall 6*a* of the ice-making water tank 6 and an upwardly oriented projection 22 close thereto.

Figure 4:
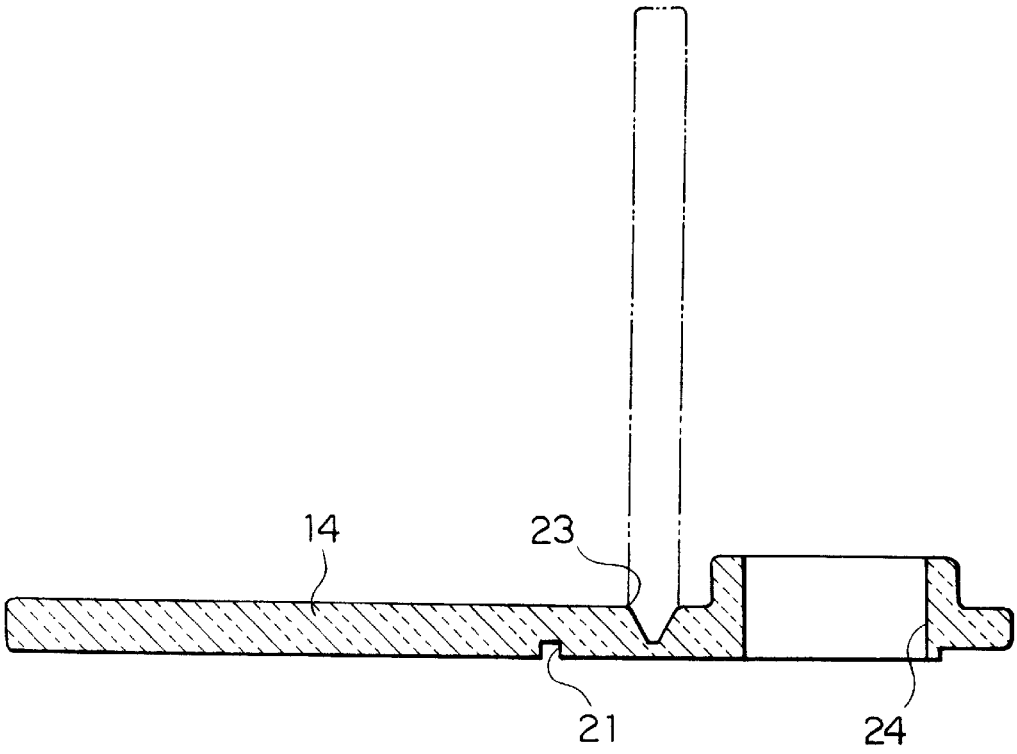
FIG. 4 is a cross-sectional view showing an insulating panel forming a rear panel.

FIG. 4 is a cross-sectional view of the rear panel 14. As shown in this figure, an elongated groove 23 having a substantially V-shape, U-shape or C-shape is formed in a predetermined portion of the rear panel 14 at which the latter is to be bent as can be understood from FIG. 4. The rear panel 14 is also formed with an opening 24 through which the motor and pump assembly extends such as seen in FIG. 1. The motor 15 is coupled to the pump 7 so that the rotation thereof is transmitted to the pump 7.

As stated above, in the ice making machine according to an embodiment of the present invention, the rear panel 14 disposed at the rear of the evaporator 5 is formed by bending one insulating panel into substantially an L-shape. Therefore, the air within the upper machine chamber 17 is prevented from flowing into the ice making chamber 3, and, in contrast with the previously described prior art, no gap is created in the rear panel 14. Accordingly, problems such as air within the upper machine chamber 17 flowing into the ice making chamber 3 to thereby elevate the temperature in the ice making chamber 3 and the ice reservoir are avoided. As a result, ice of good quality can be formed on the surfaces of the ice making plates 8.

Further, in the ice making machine according to the described embodiment of the present invention, since the elongated groove 23 is formed at the bent portion of the rear panel 14, the rear panel 14 can be easily bent.

Still further, since the rear panel 14 is formed by bending one insulating panel into substantially an L-shape, the rear panel 14 can be molded without the use of a mold having a complicated construction. Therefore, the cost required to mold the rear panel 14 can be greatly reduced.

Various details of the present invention may be changed without departing from the spirit and the scope of the invention. Furthermore, the foregoing description of the embodiments according to the invention is provided for the purpose of illustration only, and not for the purpose of limiting the present invention as defined by the appended claims and their equivalents.

What is claimed is:

1. An apparatus comprising:

a main body comprising insulating material and including a machine chamber, an ice making chamber, and an ice reservoir;

a water sprinkler in said ice making chamber;

an ice making component including at least one ice making plate arranged vertically beneath said water sprinkler so as to receive water from said water sprinkler and convert the water into ice;

an evaporator contacting said at least one ice making plate so as to cool said at least one ice making plate;

a water tank for collecting and storing run-off water from said at least one ice making plate;

an ice guide member diagonally arranged between said at least one ice making plate and said water tank so as to guide the ice from said at least one ice making plate to said ice reservoir and so as to pass run-off water from said at least one ice making plate to said water tank;

a pump in said water tank for pumping water from said water tank to said water sprinkler;

a pump motor in said machine chamber and connected to said pump so as to drive said pump;

a rear insulating panel arranged between said machine chamber and said ice making chamber, said insulating panel having a predetermined shape formed by bending said insulating panel at a predetermined position;

a substantially L-shaped fixing member extending along said insulating panel so as to hold said insulating panel in a substantially L-shape; and a control box in said machine chamber and attached to said fixing member.

2. The apparatus of claim 1, wherein said rear insulating panel includes an elongated groove at said predetermined position, said groove extending along said insulating panel in a direction of a width of said at least one ice making plate.

3. The apparatus of claim 2, wherein said groove has one of a substantially V-shape, a substantially U-shape, and a substantially C-shape.

4. The apparatus of claim 1, wherein said ice guide member includes a plurality of slits for allowing run-off water to pass therethrough.

5. An apparatus comprising:

a main body comprising insulating material and including a machine chamber, an ice making chamber, and an ice reservoir;

a water sprinkler in said ice making chamber;

an ice making component including a pair of ice making plates arranged vertically beneath said water sprinkler so as to receive water from said water sprinkler and convert the water into ice;

an evaporator arranged between said pair of ice making plates and contacting said pair of ice making plates so as to cool said pair of ice making plates;

a water tank for collecting and storing run-off water from said pair of ice making plates;

an ice guide member diagonally arranged between said pair of ice making plates and said water tank so as to guide the ice from said pair of ice making plates to said ice reservoir and so as to pass run-off water from said pair of ice making plates to said water tank;

a pump in said water tank for pumping water from said water tank to said water sprinkler;

a pump motor in said machine chamber, said pump motor being connected to said pump so as to drive said pump, wherein said machine chamber extends in a vertical direction upwardly from said water tank along said pair of ice making plates; and a rear insulating panel arranged between said machine chamber and said ice making chamber, said insulating panel having a substantially L-shape, wherein a first leg of said L-shaped panel extends along said pair of ice making plates, and a second leg of said L-shaped panel extends between said machine chamber and said water tank, said insulating panel including a support groove extending along said insulating panel in a direction of a width of said pair of ice making plates, wherein an upper end of said ice guide member is received and supported in said support groove.

6. The apparatus of claim 5, wherein said water tank includes a recess for receiving and supporting a lower end of said ice guide member, wherein said recess of said water tank and said support groove of said insulating panel hold said ice guide member at a predetermined angle.

7. The apparatus of claim 5, wherein said L-shaped insulating panel is formed by bending said insulating panel at a predetermined position, said rear insulating panel further including an elongated groove at said predetermined position, said groove extending along said insulating panel in a direction of a width of said at least one ice making plate.

8. The apparatus of claim 7, wherein said groove has one of a substantially V-shape, a substantially U-shape, and a substantially C-shape.

9. The apparatus of claim 5, wherein said ice guide member includes a plurality of slits for allowing run-off water to pass therethrough.

* * * * *